US005405203A

United States Patent [19]

Mizutani et al.

[11] Patent Number: 5,405,203

[45] Date of Patent: Apr. 11, 1995

[54] MULTICOLOR INK RIBBON HAVING BARRIER AND PROTECTIVE LAYERS

[75] Inventors: Minoru Mizutani; Masanori Maekawa, both of Tokyo, Japan

[73] Assignee: Oki Electric Industry Co., Ltd., Tokyo, Japan

[21] Appl. No.: 128,742

[22] Filed: Sep. 30, 1993

Related U.S. Application Data

[63] Continuation of Ser. No. 11,830, Feb. 1, 1993, abandoned, which is a continuation of Ser. No. 823,334, Jan. 21, 1992, abandoned.

[30] Foreign Application Priority Data

Mar. 1, 1991 [JP] Japan ..... 3-018307 U

[51] Int. Cl.[6] ..... B41J 31/05; B41J 35/16

[52] U.S. Cl. ..... 400/241.4; 400/240.4; 400/241

[58] Field of Search ..... 400/206, 216.1, 240, 400/240.1, 240.2, 240.4, 241, 241.1, 241.4

[56] References Cited

U.S. PATENT DOCUMENTS

| | | | |
|---|---|---|---|
| 2,728,439 | 12/1955 | Murphy et al. | 400/241.4 |
| 3,010,559 | 11/1961 | Ploeger, Jr. | 400/241.4 |
| 3,460,666 | 8/1969 | Ploeger, Jr. | 400/241.4 |
| 4,526,487 | 7/1985 | Ikeda | 400/201 |
| 4,569,609 | 2/1986 | Snyder, Jr. et al. | 400/241.4 |
| 4,694,305 | 9/1987 | Shiomi et al. | 400/206 |
| 4,886,386 | 12/1989 | Paffhausen et al. | 400/241.4 |

FOREIGN PATENT DOCUMENTS

| | | | |
|---|---|---|---|
| 49987 | 3/1985 | Japan | 400/241.4 |
| 127187 | 7/1985 | Japan | 400/240.2 |
| 208277 | 10/1985 | Japan | 400/241.4 |
| 284477 | 12/1986 | Japan | 400/240 |

OTHER PUBLICATIONS

IBM Technical Disclosure Bulletin, vol. 26 No. 12, May 1984, pp. 6570–6571 "Multi-color Ink Ribbon Cassette", Kanno et al.

*Primary Examiner*—Edgar S. Burr
*Assistant Examiner*—Stephen R. Funk
*Attorney, Agent, or Firm*—Spencer, Frank & Schneider

[57] ABSTRACT

A multicolor ink ribbon for use with a dot impact printer includes at least three layers. The layers include an ink layer composed of at least one colored ink ribbon having a first surface which forms a printing surface of the multicolor ink ribbon, an intermediate barrier layer having a first surface which covers a second surface of the ink layer, for preventing ink penetration from the ink layer therethrough, and a protective layer having a first surface which covers a second surface of the intermediate barrier layer and having a second surface which forms a printing head surface of the multicolor ribbon. The intermediate barrier layer prevents ink penetration from the ink layer into the protective layer, and the protective layer protects the intermediate barrier layer from physical deterioration due to impact from a printing head during use.

3 Claims, 4 Drawing Sheets

MULTICOLOR INK RIBBON HAVING BARRIER AND PROTECTIVE LAYERS

This application is a continuation of application Ser. No. 08/011,830, filed Feb. 1, 1993, (now abandoned), which is a continuation of application Ser. No. 07/823,334, filed Jan. 21, 1992, (now abandoned).

BACKGROUND OF THE INVENTION

1. Field of the Invention

The present invention relates to the structure of a multicolor ink ribbon for use with a dot impact printer.

2. Description of the Prior Art

In the past, various developments have been made with regard to a multicolor ribbon for a dot impact printer. For example, the invention disclosed in U.S. Pat. No. 4,526,487 is one of them. In this disclosure, a character or a picture image is formed in color by means of causing a printing head to strike individual colors or combinations of colors on a multicolor ink ribbon, provided with three color stripes of yellow, magenta, and cyan, or four color stripes of yellow, magenta, cyan and black, and which is contained in a cartridge equipped with a means to recirculate the ribbon.

However, the prior multicolor ink ribbon employed in a dot impact printer to perform color printing was made of a ribbon of single layer fabric in which three or four colors were impregnated in stripes, and therefore, the tip section of the printing head, or printing wire, would become soiled black due to the subtractive color mixture effects of the different inks which adhered to the tip or the wire when those colors were repeatedly printed. This was a particularly troublesome problem due to the fact that, when a printing wire in a soiled condition struck the yellow ink stripe, which was a bright color stripe, it badly soiled the yellow ink stripe of the ink ribbon so that the image created by repeated striking of the yellow ink stripe deteriorated.

SUMMARY OF THE INVENTION

It is therefore an object of the present invention to provide a multicolor ink ribbon which can prevent the printing surface from being soiled by contamination on the tip section of the printing head or the printing wire caused by the subtractive color mixture effect, so that a superior image output can be obtained. For the purpose of achieving the above mentioned goal, the multicolor ink ribbon in accordance with the present invention employs a structure consisting of an ink layer on the printing surface side, a middle barrier layer which prevents ink penetration, and a protective layer on the printing head side which protects this middle barrier layer.

BRIEF DESCRIPTION OF THE DRAWINGS

The objects and features of the present invention will become more apparent from a consideration of the following detailed description, taken in conjunction with the accompanying drawings in which.

DESCRIPTION OF THE PREFERRED EMBODIMENTS

Figure 1:
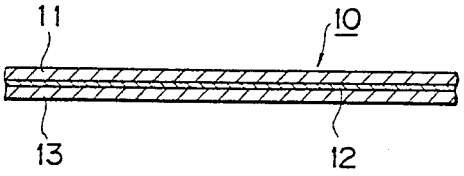
FIG. 1 is a cross-section view of the multicolor ink ribbon in accordance with the present invention.

Hereinafter, the first preferred embodiment of the present invention is explained in detail, referring to the drawings. Identical symbols are assigned to common components among the respective drawings.

Figure 4:
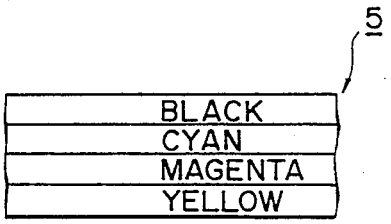
FIG. 4 (PRIOR ART)
FIG. 4 is a front view of a prior art multicolor ink ribbon.

FIG. 1 is a cross section view of the multicolor ink ribbon in accordance with the present invention. In FIG. 1, multicolor ink ribbon 10 in accordance with the present invention is constructed in at least three layers consisting of ink layer 11 on a printing surface side, middle barrier layer 12 which prevents ink penetration, and protective layer 13 which is on a printing head side and protects this middle barrier layer 12, Ink layer 11 consists of, for example, a nylon ribbon produced in a thinner form than prior ink ribbons. In this ribbon 11, four colors of, for example, black, cyan, magenta, and yellow are impregnated in stripes in the same manner as in prior ink ribbons 5, as is shown in FIG. 4. Middle barrier layer 12 is, formed, for example, of urethane rubber, silicon rubber, nylon, or a film of resin such as polyester, and in some cases, is formed of a non-porous film obtained by melting the surface of the nylon fabric base of ink ribbon 11.

Figure 3:
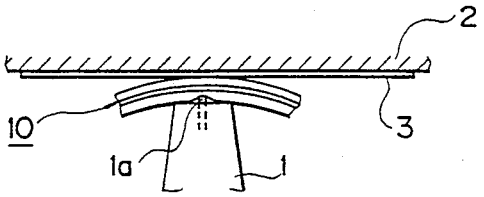
FIG. 3 is a plane view showing the printing state of the multicolor printing mechanism which employs the multicolor ink ribbon in accordance with the present invention.

Furthermore, protective layer 13 protects middle barrier layer 12 from impact during printing process. The minimum requirement for protective layer 13 is for it to function as a protective layer, and therefore, even a plain ribbon, not impregnated with any ink, is sufficient. It is also possible to employ a ribbon coated with four color inks in same manner as ink layer 11 on the printing surface side, or a ribbon coated with a lubricant oil for printing wire *b* of printing head 1. Because of the function of this protective layer 13, printing wire 1*b* does not damage barrier layer 12 located between ink layer 11 and protective layer 13 during printing on paper 3 resting against printer platen 2, as is shown in FIG. 3. Thus, barrier layer 12 can maintain a satisfactory condition for a long time without having its function impaired, even though printing wire *b* impacts against the ribbon during printing.

In the event a ribbon coated with four inks is employed as protective layer 13 in the same manner as ink layer 11, the present invention can still display its characteristic function, but its outward appearance becomes exactly the same as the prior ink ribbon. In the event a ribbon coated with a lubricant is employed, it becomes possible for this ribbon to contribute to the long term sustained performance of printing head 1.

Figure 2:
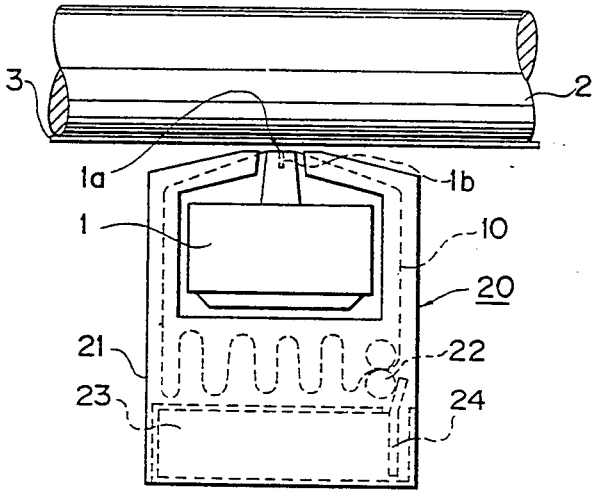
FIG. 2 is a plane view of the multicolor printing mechanism which employs a re-inking type ink ribbon cartridge containing the ink ribbons in accordance with the present invention.

FIG. 2 is a plane view of a printing mechanism employing ribbon cartridge 20 of the re-inking type in which is contained multicolor ink ribbon 10 in accordance with the present invention. In ribbon cartridge 20 in accordance with the present invention, the multicolor ink ribbon 10 contained in cartridge case 21 is sandwiched between and fed by two transfer rollers 22. These transfer rollers 22 are supplied with ink by absorbent ink storage 23 through wick 24. The ink led to transfer rollers 22 is transferred to ink layer 11 of the multicolor ink ribbon 10 (refer to FIG. 1).

As was stated above, multicolor ink ribbon 10 is constructed in multiple layers, wherein barrier layer 12, which prevents ink penetration, is provided between ink layer 11 and protective layer 13. There are two types of materials which can be used for this protective layer 13; a protective layer consisting of an ink ribbon, and a protective layer consisting of material other than the ink ribbon. In the event protective layer 13 is made of an ink ribbon, tip section 1*a* of printing head 1 or printing wire *b* may be contaminated and turn black due to the subtractive color mixture effect, but this contamination is prevented from penetrating to the printing surface side by the presence of middle barrier layer 12, and in the event protective layer 13 consists of a material other than the ink ribbon, tip section la of printing head 1 or printing wire 1*b* is not soiled by the ink, whereby it becomes possible to offer a superb printing performance even if multiple colors are repeatedly printed.

Also, in the event ribbon cartridge 20 employs a re-inking system, since the amount of ink consumed by printing is supplied through wick 24 from absorbent ink storage 23 to the printing surface side of ink layer 11 of multicolor ink ribbon 10, the printing density can be maintained so as to be constant during printing, and therefore, even more superb printing performance can be delivered by the synergism effect between this system and the function of barrier layer 12, which is one of the characteristics of the present invention.

According to the first embodiment, since all of the color stripes are formed in multiple layers, whereby the contamination on the printing head side is prevented from penetrating into the ink layer on the printing surface side by the barrier layer, all characters or picture images to be created by an individual strike or compound strikes can be printed in colors without contamination.

Figure 5:
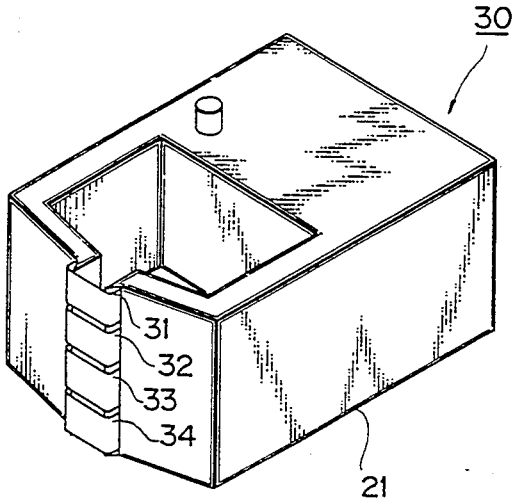
FIG. 5 is an oblique exterior view of a re-inking type ink ribbon cartridge showing another embodiment.
Figure 6:
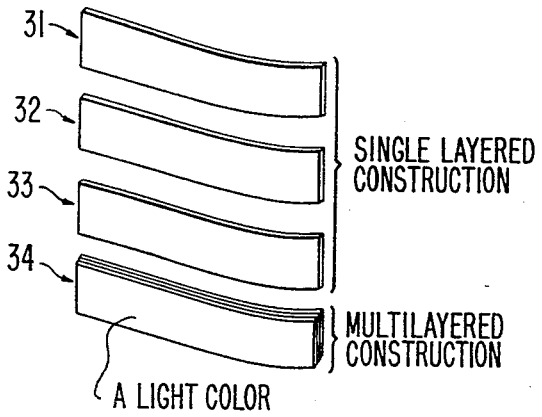
FIG. 6 is an oblique view of the multicolor printing ribbon used in the cartridge of FIG. 5.

FIG. 5 is an oblique exterior view of a re-inking type ribbon cartridge 30 showing the second embodiment. Independent ink ribbons 31 to 34 are positioned in adjacent tiers in the order of black, cyan, magenta, and yellow from the top in cartridge case 21. Among these ribbons, has shown in FIG. 6, the ink ribbon which has the multiple layer structure in accordance with the present invention is yellow ink ribbon 34, and the respective ribbons 31 to 33 of black, cyan, and magenta have the same single layer structure as the ribbons based on prior technology.

When the ribbon cartridge 30 configured in this manner is used for printing, printing is performed with proper impacts without losing the printing force, since ink ribbons 31 to 33 have a single layer structure. On the other hand, ink ribbon 34 has a multiple layer structure, which is thicker compared to ink ribbons 31 to 33, and has a cushioning effect, softening the force of impact. Therefore, there is a tendency that the yellow color is more lightly printed due to the weakened force of impact, but since magenta, cyan, and black are printed with the proper force of impact, they are not dimly printed.

Incidentally, since yellow is a light color which is difficult to see when it is independently printed, it is not generally used alone, and instead, is used to create for example, orange arid green by being printed in combination with magenta and cyan, respectively. Since magenta and cyan are not dimly printed, the orange and the green, created by printing the combination of yellow and the respective two colors, are also not dimly printed. In addition, since yellow ink ribbon 34 has a multiple layer structure, the contamination on the tip of the printing head or the printing wire does not penetrate into the ink layer of ink ribbon 34, and therefore, the orange and the green created by combination of these colors do not come out as contaminated colors.

Therefore, the dim printing is effectively eliminated, as a whole, compared to the first embodiment.

In the case of the multicolor ribbon in accordance with the present invention, since the middle barrier layer positioned between the ink ribbon and the protective layer does not allow ink penetration, the tip section of the printing head or the printing wire is not going to be soiled by the ink even if multiple colors are repeatedly printed. Even if they happened to be soiled, this contamination is blocked by the middle barrier layer, being unable to reach the printing surface side of the ribbon. Therefore, a superb printing performance can be delivered in either case. Furthermore, since the protective layer on the printing head side protects the middle barrier layer from the impacts during printing, the middle barrier layer can be maintained for a long time without having its function impaired.

Incidentally, a case in which the present invention was applied to a multicolor ribbon with four colors was explained in the above mentioned preferred embodiments, but the present invention is not restricted to a ribbon with four colors. It may be embodied in a different system in which ink ribbons of various colors are contained in the same cartridge case in place of a single multicolor ink ribbon and are individually driven. This system is also included in the concept of a multicolor ink ribbon, since it is to be used for multicolor printing.

Furthermore, in the preferred embodiment presented above, an explanation was given in the case of a multicolor ribbon having a structure consisting of at least three layers, but the present invention is not restricted to a structure consisting of three layers. It is possible to increase the number of layers. For example, barrier layer 12 or protective layer 13 may be constructed in double layers so that their functions are further enhanced.

While the present invention has been described with reference to the particular illustrative embodiments, it is not to be restricted by those embodiments, but only by the appended claims. It is to be appreciated that those skilled in the art can change or modify the embodiments without departing from the scope and spirit of the present invention.

What is claimed is:

1. A multicolor printer ribbon arrangement comprising:

at least one single layer fabric ribbon impregnated with a color in a stripe, and a light colored multilayered ribbon separate from said at least one single layer fabric ribbon comprising:

a single layer of fabric impregnated with a light color in a stripe;

an intermediate barrier layer, attached only to said single layer of fabric impregnated with a light color in a stripe, for preventing ink penetration from said stripe therethrough; and a protective layer made of a plain uninked single layer of fabric of the same material as the impregnated single layer of fabric attached to said intermediate barrier layer for protecting said intermediate barrier layer from stylus penetration, wherein said protective layer protects said intermediate barrier layer from physical deterioration due to impact from a printing head of a dot impact printer during printing and accordingly styluses of the print head of the dot impact printer are kept clean.

2. A multicolor printer ribbon arrangement according to claim 1, wherein said single layer of fabric impregnated with a light color in a stripe is impregnated with yellow color.

3. A multicolor printer ribbon arrangement according to claim 1 in combination with a cartridge, said multicolor printer ribbon arrangement being loaded into said cartridge.

* * * * *